United States Patent [19]

Itoh et al.

[11] Patent Number: 4,469,167

[45] Date of Patent: Sep. 4, 1984

[54] HEAT EXCHANGER FIN

[75] Inventors: Masaaki Itoh, Tsuchiura; Takeo Tanaka; Masakatsu Hayashi, both of Ibaraki; Mituo Kudo, Shimizu; Akira Tomita, Mito, all of Japan

[73] Assignee: Hitachi, Ltd., Tokyo, Japan

[21] Appl. No.: 326,814

[22] Filed: Dec. 2, 1981

[30] Foreign Application Priority Data

Dec. 3, 1980 [JP] Japan ..... 55-169565

[51] Int. Cl.[3] ..... F28D 1/04

[52] U.S. Cl. ..... 165/151; 165/152; 165/153

[58] Field of Search ..... 165/151, 152, 153

[56] References Cited

U.S. PATENT DOCUMENTS 4,328,861 5/1982 Cheong et al. ..... 165/151

FOREIGN PATENT DOCUMENTS 48-27263 8/1973 Japan .

54-61351 5/1979 Japan .

*Primary Examiner*—William R. Cline

*Assistant Examiner*—John F. McNally

*Attorney, Agent, or Firm*—Antonelli, Terry & Wands

[57] ABSTRACT

A heat exchanger fin according to the invention has a multiplicity of fins arranged substantially in parallel with the direction of air flow and at least one heat transfer tube to which said fins are connected in a heat conducting relation. A multiplicity of louvers inclined by a small angle to the direction of air flow are formed in said fins.

According to this construction, it is possible that the air as a whole can flow substantially straight across the heat exchanger and can strongly collide with all louvers, thereby to ensure a reduced flow resistance encountered by the air flow, as well as improved heat transfer performance of the heat exchanger.

4 Claims, 9 Drawing Figures

HEAT EXCHANGER FIN

BACKGROUND OF THE INVENTION

1. Field of the Invention

The present invention relates to a construction of fins of a heat exchanger for use in air conditioners such as room air conditioners, package-type air conditioners, automobile air conditioners or the like. More particularly, the invention is concerned with a construction of fins of a heat exchanger of the type having a heat transfer tube in which a heat transfer medium is circulated, with the fins being connected in a heat conducting relation to the heat transfer tube so that a heat exchange is performed between the heat transfer medium flowing in the heat transfer tube and a gas flowing through the gaps formed between adjacent fins.

2. Description of the Prior Art

In general, the heat exchanger incorporated in air conditioners has a heat transfer tube and a multiplicity of fins connected to the heat transfer tube at a substantially right angle to the latter. In order to obtain a high efficiency of heat exchange between the heat transfer medium flowing in the heat transfer tube and the air flowing through the gaps between adjacent fins in contact with the latter, each fin is provided with a plurality of louvers cut out and raised from the fin base plate. In this known fin structure, if the height of louvers is selected to be a half of the pitch of fins and the louvers are formed in rows parallel to the direction of air flow, the louvers are overlapped as viewed in the direction of air flow so that the heat transfer performance of the downstream louvers is adversely affected by the upstream louvers. Consequently, the heat transfer efficiency of the heat exchanger as a whole is lowered.

In order to overcome this problem, it has been proposed to select the height of louvers to be one third ($\frac{1}{3}$) of the pitch of fins and to form the louvers to protrude upwardly and downwardly from the fin base plate alternately, such that each fin has a portion where no protrusion is formed, a portion where an upward protrusion is formed and a portion where a downward protrusion is formed. This arrangement permits an increase of the gap between louvers in the direction of air flow. However, this arrangement inconveniently provides rows of louvers each of which is inclined at an angle $\theta$ to the direction of air flow. Consequently, the air flowing between adjacent louvers encounters a large flow resistance and is deflected in the direction of rows of the louvers which make the angle $\theta$ to the direction of incoming air. This means that the flow velocity of the air contacting the downstream louvers is decreased to lower the heat transfer efficiency on such louvers. In addition, the air flow as a whole is inconveniently deviated or offset to one side of the heat exchanger, resulting in an increased flow resistance against the air.

SUMMARY OF THE INVENTION

Accordingly, an object of the invention is to provide a construction of fins of heat exchanger, having a multiplicity of louvers improved to exhibit a higher heat transfer performance and a reduced flow resistance encountered by the air.

To this end, according to the invention, there is provided a construction of fins of heat exchanger in which the louvers, formed to protrude in a bridge-like form from each fin base plate, are inclined by a small angle $\gamma$ to the direction of air flow, to thereby make it possible to place strong air flow to all louvers while maintaining the air flow as a whole substantially in the same direction as the incoming air.

DESCRIPTION OF THE PREFERRED EMBODIMENTS

Figure 1:
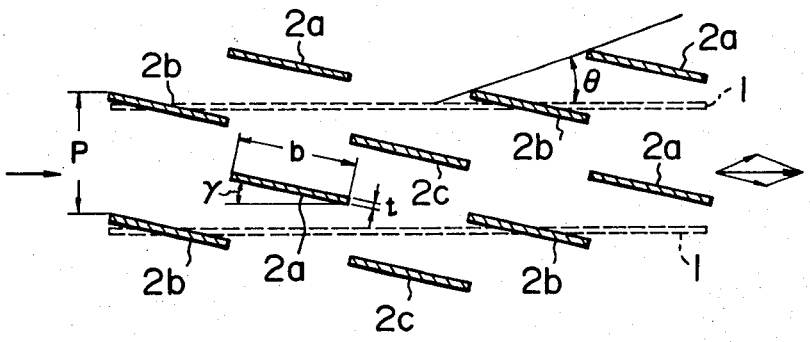
FIG. 1 is a sectional view of a fin for heat exchangers, having louvers arranged in accordance with the present invention.

As shown in FIG. 1, a plurality of fins 1 are arranged at a predetermined pitch P, with each fin 1 having a plurality of louvers *2a, 2b, 2c* inclined at a small angle $\gamma$ to the direction of incoming air flow. More specifically, each fin has three types of louvers: namely, a first louver *2a* projected above the fin base plate, a second louver *2b* formed on the fin base plate and a third louver *2c* projected to a level below the fin base plate. These fins 1 are sized such that the space between adjacent fins 1, i.e. the pitch P of the fins, is divided in the heightwise direction into three sections by the louvers *2a, 2b, 2c*. Symbols b, t and $\theta$ represent, respectively, the breadth of the louver, the thickness of the louver and the angle at which the rows of the louvers are inclined to the direction of air flow.

In the fin arrangement having fins 1 disposed in parallel at a pitch P, the angle $\theta$ of direction in which the louvers *2a, 2b, 2c* are arranged most densely is given by the following equation:

$$\tan\theta = (P/3b) \quad (1)$$

Figure 2:
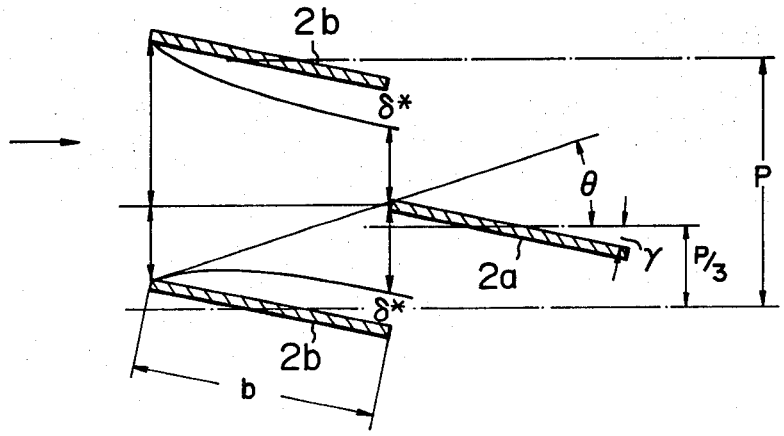
FIG. 2 is an illustration showing the relationship between the inclination angle of louvers and the state of air flowing into the gap between adjacent fins, in a heat exchanger having fins constructed in accordance with the invention.

In order to maintain the air flow as a whole substantially straight across the heat exchanger, it is necessary to incline each louver at a small attack angle $\gamma$ in the direction opposite to the direction of inclination angle $\theta$. It is necessary that the attack angle meets the following condition:

$$\sin\gamma = (t + \delta^*)\left(\frac{1}{b} - \frac{2\tan\theta}{P}\right) \quad (2)$$

where the symbol $\delta^*$ (FIG. 2) represents a removal thickness which is given by the following equation:

$$\delta^* = 1.72\frac{b}{\sqrt{Re}} \quad (3)$$

In equation (3) above, Re represents a Reynolds number determined on the basis of the breadth b of louver as the representative length. The Reynolds number Re is given by the following equation:

$$Re = ub/\nu \quad (4)$$

where u represents the flow velocity of air before coming into the heat exchanger, while $\nu$ represents the coefficient of kinematic viscosity of air.

The following equation is derived from the equations (1) and (2):

$$\sin\gamma = (1+\delta)/3b$$

The optimum attack angle will be calculated on an assumption that the flow velocity u, breadth b, pitch P and the thickness t are, respectively, 2.0 m/sec, 2.0 mm, 2.3 mm and 0.16 mm. The coefficient of kinematic viscosity of air $\nu$ is $0.156\times10^{-4}$ m²/s at 20° C.

The Reynolds number Re is calculated as follows:

$$Re = \frac{ub}{\nu} = \frac{2.0\times2.0\times10^{-3}}{0.156\times10^{-4}} = 256.$$

Using this value of the Reynolds number, the removal thickness $\delta^*$ is calculated from the equation (3) as follows:

$$\delta^* = 1.72\frac{b}{\sqrt{Re}} = 1.72\frac{2.0\times10^{-3}}{\sqrt{256}}$$

$$= \zeta^* 0.215\times10^{-3}\,(m)$$

On the other hand, the angle $\theta$ is calculated from the equation (1) as follows:

$$\tan\theta = \frac{P}{3b} = \frac{2.3\times10^{-3}}{3\times2.0\times10^{-3}} = 0.383$$

$$\therefore = 21.0°.$$

Therefore, the attack angle $\gamma$ is calculated from the equation (2) as follows.

$$\sin\gamma = (t + \delta^*)\left(\frac{1}{b} - \frac{2\tan\theta}{p}\right)$$

$$\sin\gamma = (0.16 + 0.215)\left(\frac{1}{2.0} - \frac{2\tan 21°}{2.3}\right)$$

$$\sin\gamma = 0.0623 \therefore \gamma = 3.57°.$$

It will be understood that the heat exchange performance of the fins having louvers can be remarkably improved by imparting an attack angle which is as small as about 4° to the louvers.

In general, in the heat exchangers in which the heat is exchanged between air and a heat transfer medium, the attack angle is preferably selected to fall within a range of ±3°, in order to meet the demand for precision in the production. A too large attack angle causes an impractically large increase of the flow resistance to deteriorate the heat exchange performance of the fins.

In the case where the pitch P of fins is divided by the louvers into sections of a number n greater than 3, the following equation (1') should be used in place of the aforementioned equation (1):

$$\tan\theta = (P/nb) \quad (1')$$

Equations (2), (3) and (4) directly apply also to this case.

Figure 4:
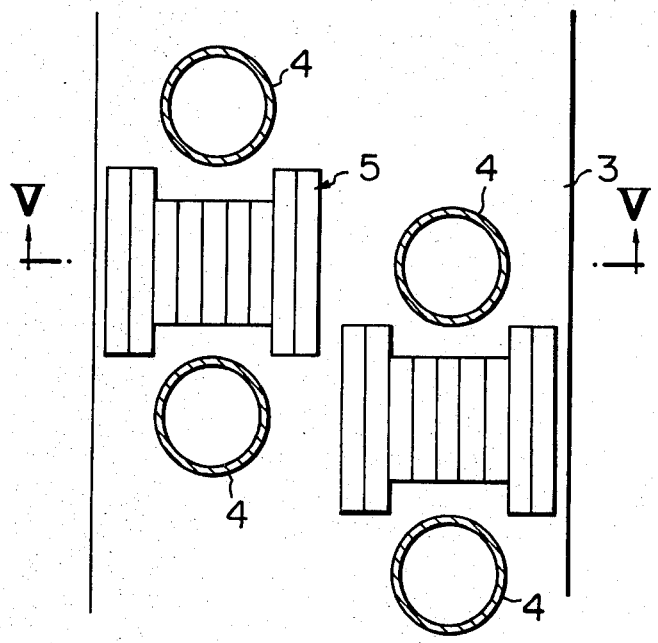
FIG. 4 is a schematic front elevational view of a heat exchanger fin in accordance with the invention applied to a cross fin-tube type heat exchanger.
Figure 5:
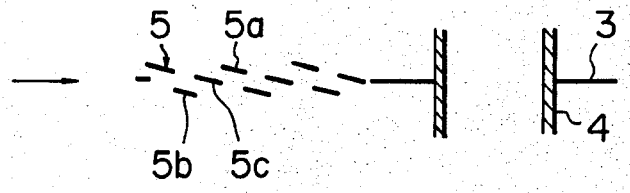
FIG. 5 is a sectional view taken along the line V—V of FIG. 4.

As shown in FIGS. 4 and 5, a heat exchanger includes a plurality of fins 3 arranged in a side-by-side relation, with a plurality of heat transfer tubes 4, arranged in a staggered manner, extending through each fin 3. A plurality of louvers generally designated by the reference numeral 5 are formed in the portion of the fin 3 between adjacent heat transfer tubes 4. More specifically, as will be understood from FIG. 5, the louvers 5 are sorted into three groups. The first louver 5*a* extends at a height which is ⅓ of the fin pitch P above the fin, while the second louver 5*b* extends at a level which is ⅓ P below the fin. The third louver 5*c* is on the fin base plate. These louvers 5 are inclined to the direction of air flow at an attack angle $\gamma$ which may be extremely small. More specifically, the attack angle $\gamma$ is usually selected to fall between 1° and 7°. When the circumstance allows a precise determination of the attack angle, the attack angle $\gamma$ is determined in accordance with the equation (2). As stated before, the equation (1') is used in place of the equation (1) in solving the equation (2), when the fin pitch P is divided by the louvers 5 in the heightwise direction into groups of a number n greater than 3.

The air flowing into the gap between fins 3 comes into contact with the louvers 5 having a small attack angle so that the streams of air flow are distributed to form an air flow which, as a whole, moves in the same direction as the incoming air.

Figure 3:
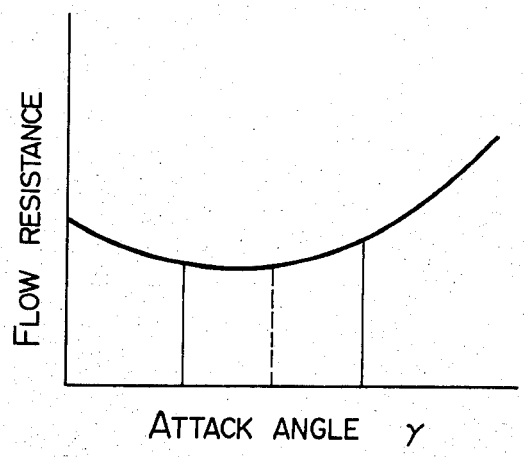
FIG. 3 is a graphical representation of the relationship between the attack angle of the louver and the flow resistance against the air flow.
Figure 6:
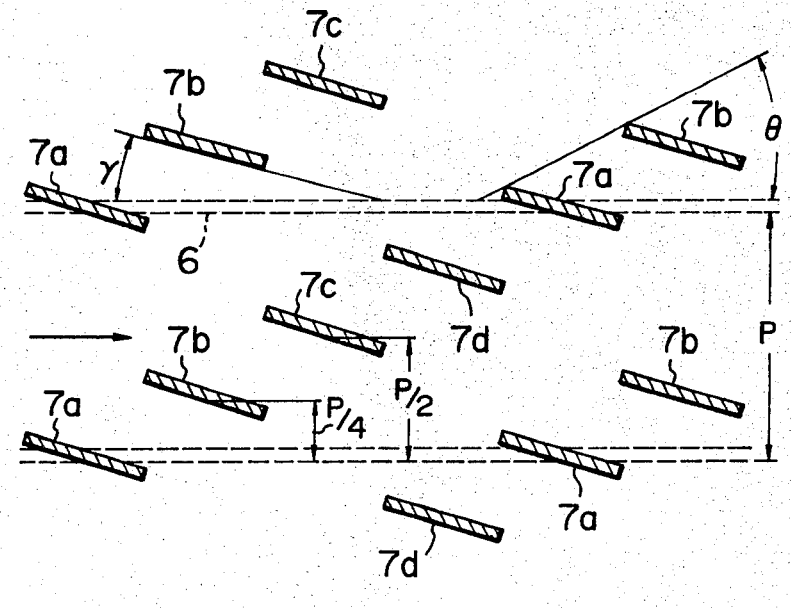
FIG. 6 is a sectional view of fins in which the space between adjacent fins is divided into four sections by louvers.

In FIG. 6 the pitch P of fins 6 is divided by louvers 7 in the heightwise direction into four sections (n=4). In this case, the attack angle $\gamma$ is determined using the equations (1'), (2), (3) and (4). In this case, the louvers 7 are sorted into four groups: namely, a louver 7*a* formed on the fin base plate and having an attack angle $\gamma$, a louver 7*b* formed to extend at a level of P/4 above the fin base plate and having the attack angle $\gamma$, a louver 7*c* formed to extend at the level of P/2 above the fin base plate and having the attack angle $\gamma$, and a louver 7*d* formed to extend at a level of P/4 below the fin base plate and having the attack angle $\gamma$. As will be seen from FIG. 3, the flow resistance is varied depending on the attack angle of the louvers. The flow resistance in the heat exchanger as a whole is increased by an excessively small attack angle, as well as by an excessively large attack angle, of the louvers.

Generally speaking, taking into account the change in the flow velocity of air and the precision of the mechanical processing, the practical allowable error of the attack angle is ±3°. This means that the attack angle $\gamma$ is preferably selected to range between 1° and 7°, because, the optimum attack angle is usually about 4° as will be understood from examples of calculations with representative numerical data.

Figure 7:
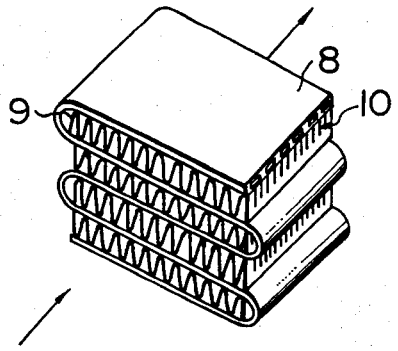
FIG. 7 is a perspective view of heat exchanger fins of the invention applied to a corrugated fin type heat exchanger.
Figure 8:
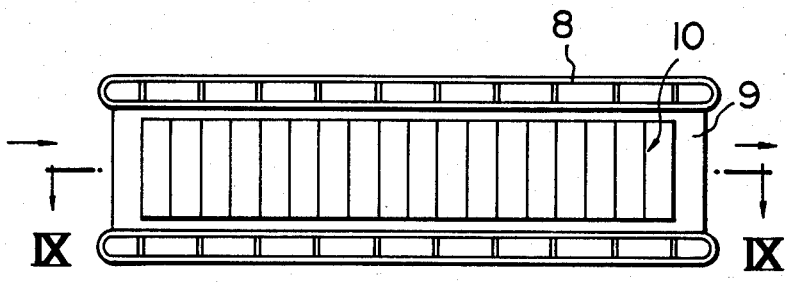
FIG. 8 is a sectional view of the fin as shown in FIG. 7, taken along a line parallel to the fins.
Figure 9:
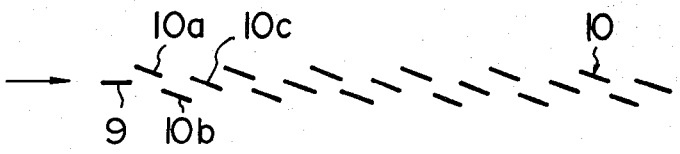
FIG. 9 is a sectional view taken along the line IX—IX of FIG. 8.

As shown in FIGS. 7 to 9 a corrugated fin type heat exchanger has a winding heat transfer tube 8 having a flattened cross-section, through which the heat transfer medium is circulated. A continuous fin 9, corrugated in a form resembling a wave, is disposed between adjacent parallel runs of the heat transfer tube 8. A plurality of louvers generally designated by the reference numeral 10 are formed in the fin 9. More specifically, the louvers 10 are sorted into three groups: namely a louver 10*a* protruded from one side of the fin 9, a louver 10*c* on the fin base plate and a louver 10*b* protruded from the other side of the fin. These louvers 10 are inclined to the direction of incoming air flow at a small attack angle. In this embodiment, it is possible to obtain a high heat transfer performance of the heat exchanger, as well as a reduced flow resistance against air across the heat exchanger, as in the case of the foregoing embodiment, thanks to the small attack angle imparted to the louvers.

As has been described, according to the invention, it is possible to obtain an improved construction of fins of heat exchanger in which, due to the specific arrangement of the louvers formed in each fin, the air as a whole can flow substantially straight across the heat exchanger and can strongly collide with all louvers, thereby ensuring a reduced flow resistance encountered by the air flow, as well as an improved heat transfer performance of the heat exchanger.

What is claimed is:

1. A heat exchanger fin for use in a heat exchanger of the type having a plurality of fins arranged substantially in parallel with a direction of air flow, the air flowing through a space between adjacent fins, said fins comprising a plurality of louvers cut and raised in a bridge-like form therefrom substantially perpendicular to the direction of said air flow, said louvers dividing said space between adjacent fins in a heightwise direction into n sections wherein $n \geqq 3$, said louvers being inclined to a direction of air flow at a small attack angle, at least one of the louvers of each of said fins being cut and raised in such a manner that one end of the louver is positioned above an upper surface of the fin and a second end is positioned below a lower surface of the fin to divide the air flow into a flow above and below the louver, at least another one of the louvers of each said fins being cut and raised in such a manner that both ends are positioned above the upper surface of the fin, and at least one other of the louvers being cut and raised in such a manner that both ends of said louver are positioned below the lower surface of the fin, and wherein said attack angle $\gamma$ (degrees) is determined to satisfy the following condition:

$$\sin\gamma = (t + \delta^*)\left(\frac{1}{b} - \frac{2\tan\theta}{p}\right),$$

-continued where, $$\tan\theta = \frac{P}{nb},$$

$$\delta^* = 1.72\frac{1}{\sqrt{Re}},$$

$$Re = \frac{ub}{\nu},$$

wherein, t represents a thickness (m) of a fin, b represents the breadth (m) of a fin, P represents the pitch (m) of the fins, u represents the flow velocity (m/sec) of air and $\nu$ represents the kinematic viscosity ($m^2/S$) of air.

2. A heat exchanger fin as claimed in claim 1, wherein the attack angle is determined within $\pm 3°$.

3. A heat exchanger for use in heat exchanger of the type having a plurality of fins arranged substantially in parallel with a direction of air flow, the air flowing through a space between adjacent fins, said fins comprising a plurality of louvers cut and raised in a bridge-like form therefrom substantially perpendicular to the direction of said air flow, said louvers dividing said space between adjacent fins in a heightwise direction into n sections wherein $n \geqq 3$, said louvers being inclined to the direction of air flow at a small attack angle, at least one of the louvers of each of said fins being cut and raised in such a manner that one end of the louver is positioned above an upper surface of the fin and a second end is positioned below a lower surface of the fin to divide the air flow into a flow above and below the louver, at least another one of the louvers of each of said fins being cut and raised in such a manner that both ends are positioned above the upper surface of the fin, and at least one other of the louvers being cut and raised in such a manner that both ends of said louver are positioned below the lower surface of the fin, and wherein said attack angle $\gamma$ (degrees) is determined to satisfy the following condition:

$$\sin\gamma = (t + \delta^*)/3b,$$

where $$\delta^* = 1.72\frac{b}{\sqrt{Re}},$$

$$Re = \frac{ub}{\nu},$$

wherein, t represents the thickness (m) of fin, b represents the breadth (m) of fin, P represents the pitch (m) of fins, u represents the flow velocity (m/s) of air, and $\nu$ represents the kinematic viscosity of air.

4. A heat exchanger fin as claimed in claim 3, wherein the attack angle is determined with $\pm 3°$.

* * * * *